US007581927B2

(12) United States Patent
Cunha

(10) Patent No.: US 7,581,927 B2
(45) Date of Patent: Sep. 1, 2009

(54) SERPENTINE MICROCIRCUIT COOLING WITH PRESSURE SIDE FEATURES

(75) Inventor: Francisco J. Cunha, Avon, CT (US)

(73) Assignee: United Technologies Corporation, Hartford, CT (US)

( * ) Notice: Subject to any disclaimer, the term of this patent is extended or adjusted under 35 U.S.C. 154(b) by 537 days.

(21) Appl. No.: 11/494,876

(22) Filed: Jul. 28, 2006

(65) Prior Publication Data

US 2009/0097977 A1 Apr. 16, 2009

(51) Int. Cl.
*F01D 5/18* (2006.01)

(52) U.S. Cl. ..... 416/96 R; 416/95; 415/115; 415/175; 415/178

(58) Field of Classification Search ..... 415/115, 415/175, 177, 178; 416/95, 96 R See application file for complete search history.

(56) References Cited

U.S. PATENT DOCUMENTS

| | | | | |
|---|---|---|---|---|
| 5,484,258 | A * | 1/1996 | Isburgh et al. | 415/115 |
| 6,247,896 | B1 * | 6/2001 | Auxier et al. | 416/97 R |
| 6,264,428 | B1 * | 7/2001 | Dailey et al. | 416/97 R |
| 6,705,831 | B2 * | 3/2004 | Draper | 415/115 |
| 7,137,776 | B2 * | 11/2006 | Draper et al. | 415/115 |

* cited by examiner

*Primary Examiner*—Igor Kershteyn
(74) *Attorney, Agent, or Firm*—Bachman & LaPointe, P.C.

(57) ABSTRACT

In accordance with the present invention, there is provided a turbine engine component having an airfoil portion with a pressure side and a suction side, a first microcircuit embedded in a wall forming the pressure side, an internal cavity containing a supply of cooling fluid, the first microcircuit having an inlet leg, an intermediate leg, and an outlet leg, and a plurality of communication holes between the internal cavity and the outlet leg. In a preferred embodiment, the outlet leg is provided with at least one set of features for locally accelerating cooling flow in the outlet leg and for increasing heat pick-up ability.

27 Claims, 4 Drawing Sheets

SERPENTINE MICROCIRCUIT COOLING WITH PRESSURE SIDE FEATURES

BACKGROUND (1) Field of the Invention

The present invention relates to a turbine engine component having an airfoil portion with a serpentine cooling microcircuit embedded in the pressure side, which serpentine cooling microcircuit is provided with a way to increase coolant pressure and a way to accelerate local cooling flow and increase the ability to pick-up heat.

(2) Prior Art

The overall cooling effectiveness is a measure used to determine the cooling characteristics of a particular design. The ideal non-achievable goal is unity, which implies that the metal temperature is the same as the coolant temperature inside an airfoil. The opposite can also occur when the cooling effectiveness is zero implying that the metal temperature is the same as the gas temperature. In that case, the blade material will certainly melt and burn away. In general, existing cooling technology allows the cooling effectiveness to be between 0.5 and 0.6. More advanced technology such as supercooling should be between 0.6 and 0.7. Microcircuit cooling as the most advanced cooling technology in existence today can be made to produce cooling effectiveness higher than 0.7.

FIG. 1 shows a durability map of cooling effectiveness (x-axis) vs. the film effectiveness (y-axis) for different lines of convective efficiency. Placed in the map is a point 10 related to a new advanced serpentine microcircuit shown in FIGS. 2*a*-2*c*. This serpentine microcircuit includes a pressure side serpentine circuit 20 and a suction side serpentine circuit 22 embedded in the airfoil walls 24 and 26.

The Table I below provides the operational parameters used to plot the design point in the durability map.

TABLE I

| Operational Parameters for serpentine microcircuit | |
|---|---|
| Beta | 2.898 |
| Tg | 2581 [F] |
| Tc | 1365 [F] |
| Tm | 2050 [F] |
| Tm_bulk | 1709 [F] |
| Phi_loc | 0.437 |
| Phi_bulk | 0.717 |
| Tco | 1640 [F] |
| Tci | 1090 [F] |
| eta_c_loc | 0.573 |
| eta_f | 0.296 |
| Total Cooling | 3.503% |
| Flow | 10.8 |
| WAE | |

Legend for Table I
Beta = heat load
Phi_loc = local cooling effectiveness
Phi_bulk = bulk cooling effectiveness
Eta_c_loc = local cooling efficiency
Eta_f = film effectiveness
Tg = gas temperature
Tc = coolant temperature
Tm = metal temperature
Tm_bulk = bulk metal temperature
Tco = exit coolant temperature
Tci = inlet coolant temperature
WAE = compressor engine flow, pps It should be noted that the overall cooling effectiveness from the table is 0.717 for a film effectiveness of 0.296 and a convective efficiency (or ability to pick-up heat) of 0.573. Also note that the corresponding cooling flow for a turbine blade having this cooling microcircuit is 3.5% engine flow. FIG. 3 illustrates the cooling flow distribution for a turbine blade with the serpentine microcircuits of FIGS. 2*a*-2*c* embedded in the airfoils walls.

It should be noted from FIG. 3 that the flow passing through the pressure side serpentine microcircuit 20 is 1.165% WAE (compressor engine flow) in comparison with 0.428 WAE for the suction side serpentine microcircuit 22. This represents a 2.7 fold increase in cooling flow relative to the suction side microcircuit. The reason for this increase stems from the fact that the thermal load to the part is considerably higher for the airfoil pressure side. As a result, the height of the microcircuit channel should be 1.8 fold increase over that of the suction side. That is 0.022 inches vs. 0.012 inches. Besides the increased flow requirement, the driving potential in terms of source to sink pressures for the pressure side circuit 20 is not as high as that for the suction side circuit 22. In considering the coolant pressure on the pressure side circuit 20, at the end of the third or outlet leg, the back flow margin, as a measure of internal to external pressure, is low. As a consequence of this back flow issue, the metal temperature increases beyond the required metal temperature close to the third leg of the pressure side circuit 20. It is desirable to eliminate this problem.

SUMMARY OF THE INVENTION

In accordance with the present invention, there is provided two solutions. The first is to include communication holes between the internal cavity and the microcircuit third leg so as to have an increased source of local pressure. It should be noted that the flow inside the inner cavity is high compared to that on the microcircuit legs with many loss mechanisms. The second is to include a set of features which are used to locally accelerate the flow and increase the ability for heat pick-up in the third leg of the pressure side circuit.

In accordance with the present invention, there is provided a turbine engine component having an airfoil portion with a pressure side and a suction side, a first microcircuit embedded in a wall forming the pressure side, an internal cavity containing a supply of cooling fluid, the first microcircuit having an inlet leg, an intermediate leg, and an outlet leg, and means for locally increasing pressure within the outlet leg. The means for locally increasing pressure within the outlet leg preferably comprises a plurality of communication holes between the internal cavity and the outlet leg.

Further, in accordance with the present invention, there is provided a turbine engine component having an airfoil portion with a pressure side and a suction side, a first microcircuit embedded in a wall forming the pressure side, said first microcircuit having an inlet leg, an intermediate leg, and an outlet leg, and means in the outlet leg for locally accelerating cooling flow in the outlet leg and for increasing heat pick-up ability.

Other details of the serpentine microcircuit cooling with pressure side features of the present invention, as well as other objects and advantages attendant thereto are set forth in the following detailed description and the accompanying drawings wherein like reference numerals depict like elements.

DETAILED DESCRIPTION OF THE PREFERRED EMBODIMENT(S)

Figure 5:
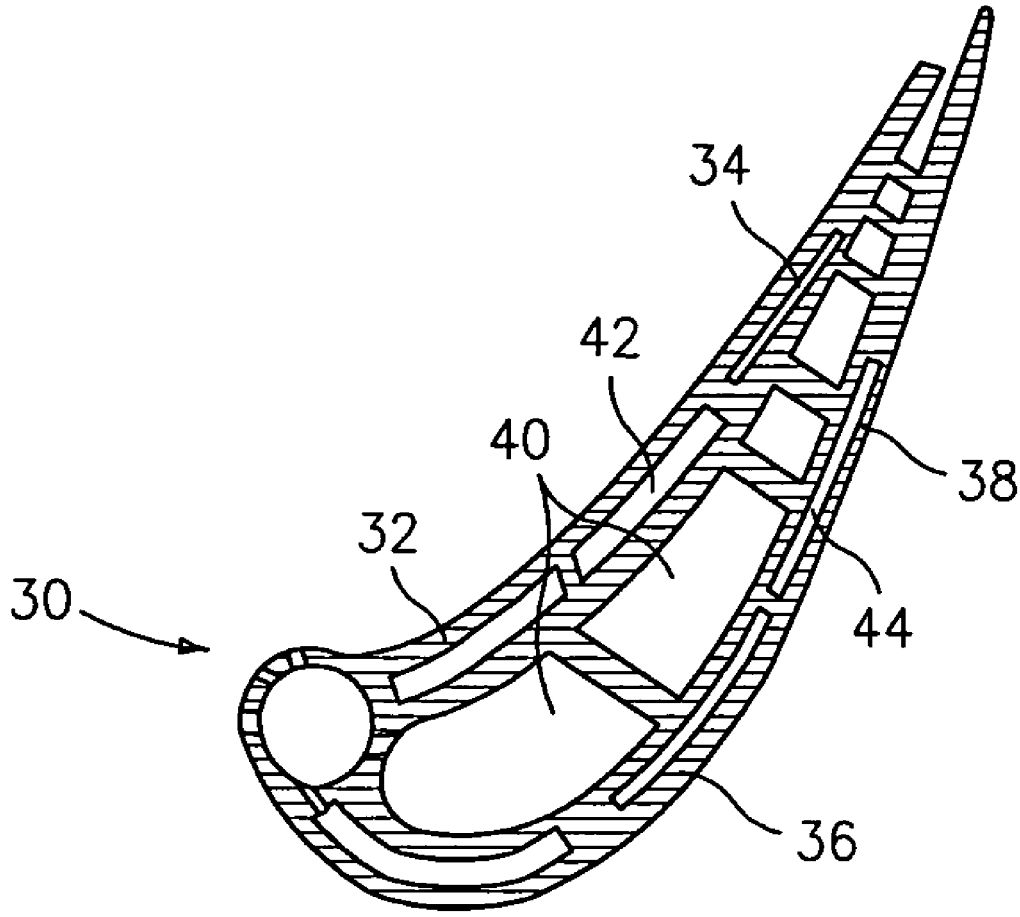
FIG. 5 illustrates a turbine engine component having embedded pressure side and suction side cooling microcircuits.

Referring now to FIG. 5, there is shown an airfoil portion 30 of a turbine engine component. The turbine engine component may comprise a turbine blade or any other component having an airfoil portion.

The airfoil portion 30 has a pressure side 32 formed by a pressure side wall 34 and a suction side 36 formed by a suction side wall 38. The airfoil portion 30 further has a plurality of internal cavities 40 through which a cooling fluid flows. Embedded in the pressure side wall 34 is a serpentine cooling microcircuit 42. Embedded in the suction side wall 38 is a serpentine cooling microcircuit 44.

Figure 1:
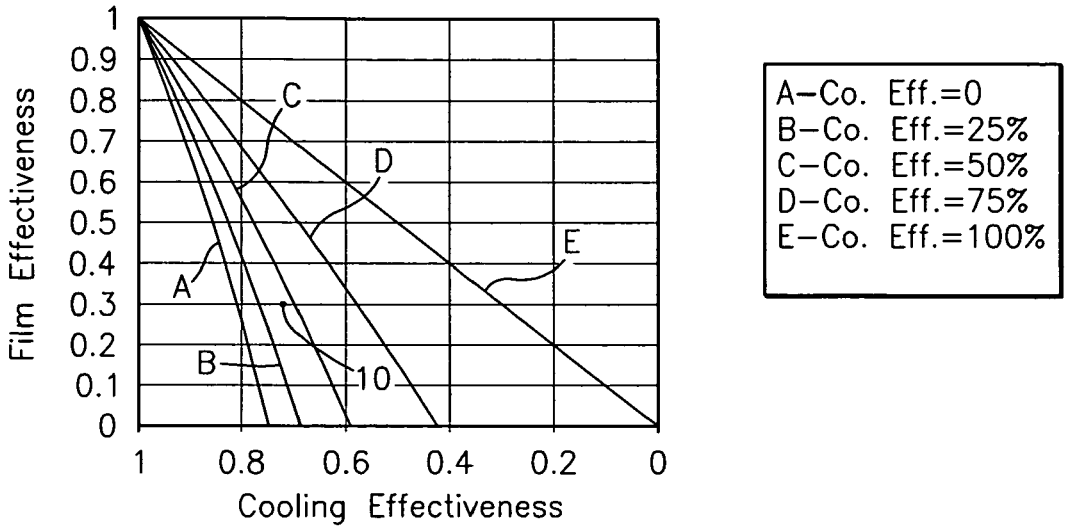
FIG. 1 is a graph showing cooling effectiveness versus film effectiveness for a turbine engine component.
Figure 2C:
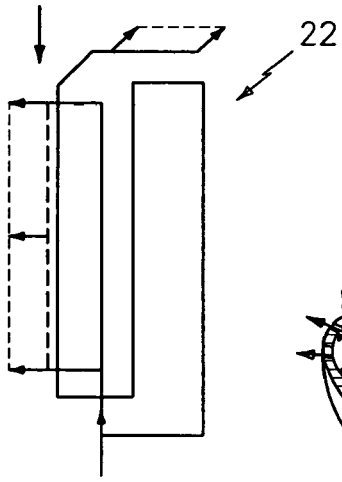
FIG. 2C is a schematic representation of a suction side cooling microcircuit used in the airfoil portion of FIG. 2A.
Figure 2A:
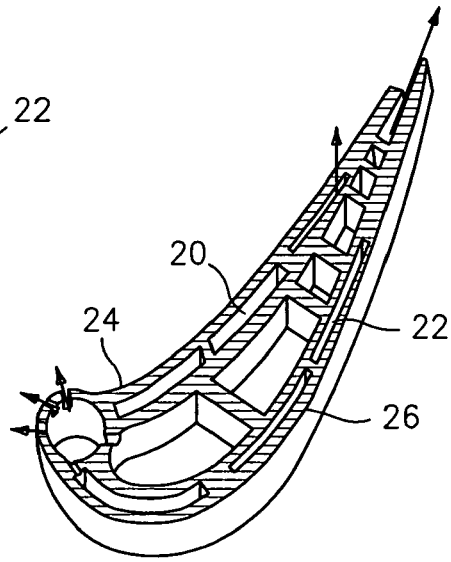
FIG. 2A shows an airfoil portion of a turbine engine component having a pressure side cooling microcircuit embedded in the pressure side wall and a suction side cooling microcircuit embedded in the suction side wall.
Figure 2B:
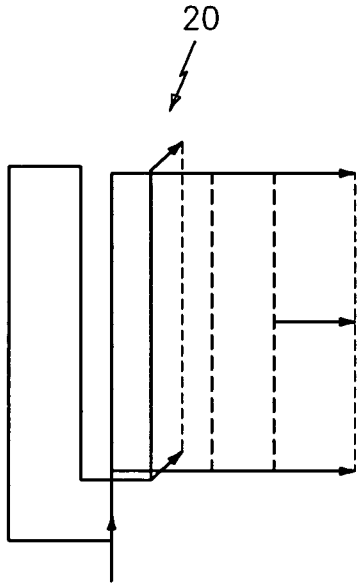
FIG. 2B is a schematic representation of a pressure side cooling microcircuit used in the airfoil portion of FIG. 2A.
Figure 3:
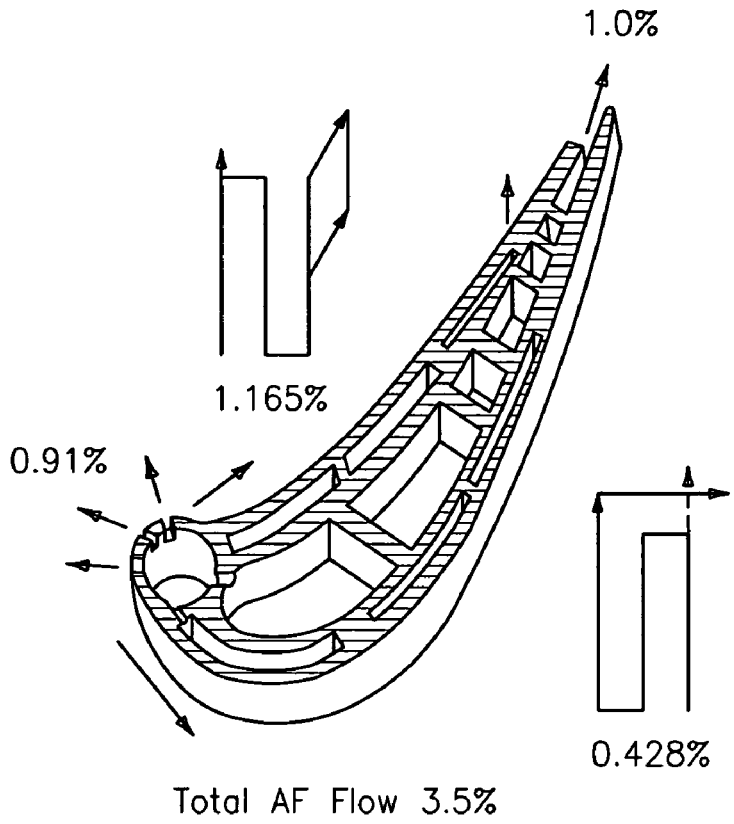
FIG. 3 illustrates the cooling flow distribution for a turbine engine component with serpentine microcircuits embedded in the airfoil walls.
Figure 4A:
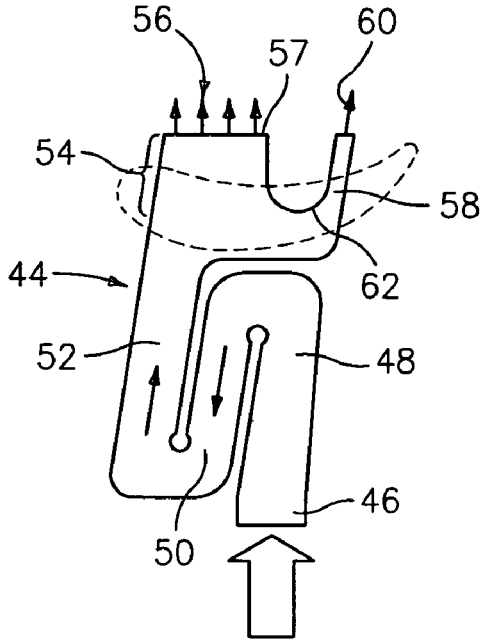
FIG. 4A is a schematic representation of a suction side circuit used in a turbine engine component in accordance with the present invention.

Referring now to FIG. 4A, there is shown a schematic representation of the serpentine cooling microcircuit 44. The serpentine cooling microcircuit 44 includes an inlet 46 which communicates with one of the internal cavities 40. The microcircuit 44 further includes an inlet leg 48, an intermediate leg 50, and outlet leg 52. The outlet leg 52 has a first portion 54 with a plurality of film cooling holes 56 for allowing cooling fluid to flow over a tip portion 57 of the airfoil portion 30. The outlet leg also has a second portion 58 with at least one film cooling hole 60 for allowing cooling fluid to flow over the tip portion 57. A U-shaped portion 62 is provided as part of the cooling microcircuit 44. Within the space defined by the U-shaped portion 62, there is located an outlet nozzle of the pressure side cooling microcircuit 42.

Figure 4B:
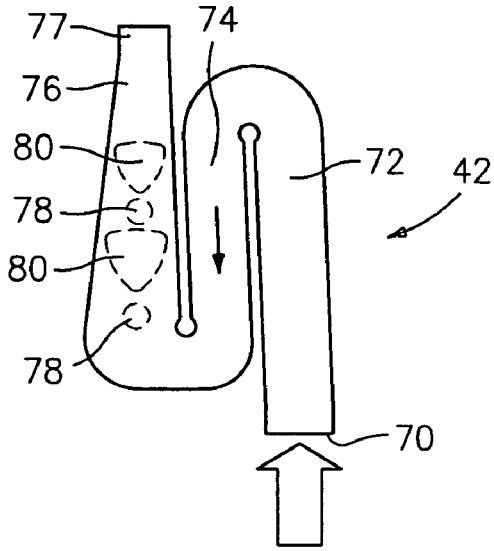
FIG. 4B is a schematic representation of a pressure side circuit used in a turbine engine component in accordance with the present invention.

Referring now to FIG. 4B, there is shown a pressure side cooling microcircuit 42. The pressure side cooling microcircuit 42 also has an inlet 70 which communicates with one of the internal cavities. The inlet 70 supplies cooling fluid to the inlet leg 72. Cooling fluid flows through the inlet leg 72 to the intermediate leg 74 and eventually to the outlet leg 76. The outlet leg 76 has at least one outlet cooling hole 77.

In accordance with a preferred embodiment of the present invention, a plurality of communication holes 78 are provided in the outlet leg 76. The communication holes 78 are spaced apart in a direction of flow of the cooling fluid within the outlet leg 76. The communication holes 78 allow cooling fluid to flow from one of the internal cavities 40 into the outlet leg 76. The communication holes 78 provide an increased source of pressure locally.

Figure 6:
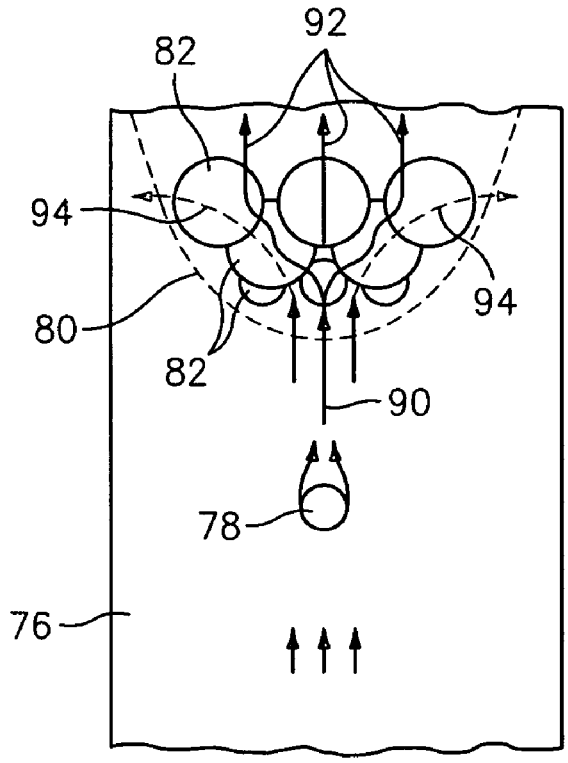
FIG. 6 illustrates a trip strip arrangement which can be used in a pressure side circuit.
Figure 7:
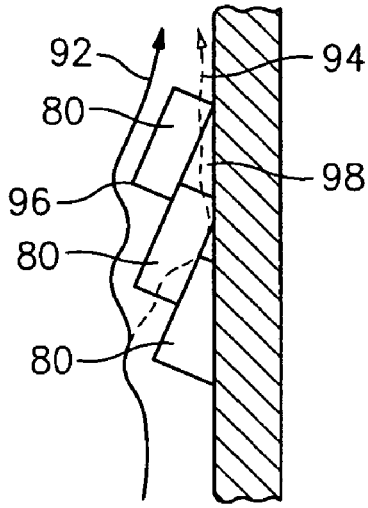
FIG. 7 illustrates a side view of the trip strip arrangement of FIG. 6.

Further in accordance with a preferred embodiment of the present invention, the outlet leg 76 is also provided with a plurality of features 80 which are used to locally accelerate the cooling fluid flow and increase the ability for heat-pick up in the outlet leg 76. Referring now to FIGS. 6 and 7, each of the features 80 preferably comprises a series of round trip strips 82 placed on top of each other. Each of the trip strips 82 are preferably connected to a hot wall 84 of the pressure side. The trip strips 82 may be cast trip strips. Alternatively, the trip strips 82 may be trip strips which are bonded to the wall 84 using any suitable bonding technique known in the art.

The trip strips 82 provide a number of advantages. First the approach flow 90 of cooling fluid is split into two major branches. The first branch is a top flow 92 and the second branch is the bottom flow 94. As the flow is split, the top flow branch 92 picks up heat by transport over the series of features through turbulation and through the thermal conduction efficiency of the pin fins 96 protruding in the main flow field. As the flow is split, the bottom flow branch 94 enters the mini-crevices 98 underneath the trip strips 82, thus accelerating the flow locally and transporting heat into the main stream. In this way, the re-supply or communication holes 78 provide a way to increase the coolant pressure and the sets of features 80 provide ways to accelerate the flow locally and increase the ability to pick-up heat, thus increasing the internal convective efficiency. The combined effect substantially eliminates the low back flow margin and overtemperature problems in the aft pressure side portion of the airfoil portion 30.

As can be seen from the foregoing description, there has been provided in accordance with the present invention a serpentine microcircuit cooling with pressure side features which fully satisfies the objects, means, and advantages set forth hereinbefore. While the present invention has been described in the context of specific embodiments thereof, other unforeseen alternatives, modifications and variations may become apparent to those skilled in the art having read the foregoing description. Accordingly, it is intended to embrace those alternatives, modifications, and variations as fall within the broad scope of the appended claims.

What is claimed is:

1. A turbine engine component comprising:

an airfoil portion with a pressure side and a suction side;

a first cooling microcircuit embedded in a wall forming the pressure side;

an internal cavity containing a supply of cooling fluid;

said first cooling microcircuit having an inlet leg, an intermediate leg, and an outlet leg through which a cooling fluid flows; and means for locally increasing pressure within said outlet leg.

2. The turbine engine component according to claim 1, wherein said means for locally increasing pressure within said outlet leg comprises a plurality of communication holes between said internal cavity and said outlet leg.

3. The turbine engine component of claim 2, wherein said communication holes are spaced apart in a direction of flow of said cooling fluid within said outlet leg.

4. The turbine engine component according to claim 1, further comprising means in said outlet leg for locally accelerating cooling flow in said outlet leg and for increasing heat pick-up ability.

5. The turbine engine component according to claim 4, wherein said means for locally accelerating cooling flow comprises at least one set of trip strips placed on top of each other.

6. The turbine engine component according to claim 5, wherein said trip strips are connected to a hot wall of said pressure side.

7. The turbine engine component according to claim 6, wherein said trip strips are each bonded to the hot wall.

8. The turbine engine component according to claim 6, wherein said trip strips are cast trip strips.

9. The turbine engine component according to claim 5, wherein said trip strips are each round.

10. The turbine engine component according to claim 5, wherein said trips strips form a plurality of mini-crevices on an underside of said trip strips.

11. The turbine engine component according to claim 5, further comprising a plurality of spaced apart sets of trip strips.

12. The turbine engine component according to claim 11, wherein said sets of trips strips are spaced apart in a direction of flow of said cooling fluid in said outlet leg.

13. The turbine engine component according to claim 5, wherein said trip strips create a first branch of cooling fluid for picking up heat by transport over said trip strips and a second branch which flows beneath said trip strips for accelerating a local flow of cooling fluid and transporting heat.

14. The turbine engine component according to claim 1, further comprising a second cooling microcircuit embedded within a suction side wall.

15. The turbine engine component according to claim 14, wherein said second cooling microcircuit has a U-shaped portion and said first cooling microcircuit has an outlet nozzle positioned within a space defined by said U-shaped portion.

16. A turbine engine component comprising:

an airfoil portion with a pressure side and a suction side;

a first microcircuit embedded in a wall forming the pressure side;

said first microcircuit having an inlet leg, an intermediate leg, and an outlet leg; and means in said outlet leg for locally accelerating cooling flow in said outlet leg and for increasing heat pick-up ability.

17. The turbine engine component according to claim 16, wherein said means for locally accelerating cooling flow comprises at least one set of trip strips placed on top of each other.

18. The turbine engine component according to claim 17, wherein said trip strips are connected to a hot wall of said pressure side.

19. The turbine engine component according to claim 18, wherein said trip strips are each bonded to the hot wall.

20. The turbine engine component according to claim 18, wherein said trip strips are cast trip strips.

21. The turbine engine component according to claim 17, wherein said trip strips are each round.

22. The turbine engine component according to claim 17, wherein said trips strips form a plurality of mini-crevices on an underside of said trip strips.

23. The turbine engine component according to claim 17, further comprising a plurality of spaced apart sets of trip strips.

24. The turbine engine component according to claim 23, wherein said sets of trips strips are spaced apart in a direction of flow of said cooling fluid in said outlet leg.

25. The turbine engine component according to claim 17, wherein said trip strips create a first branch of cooling fluid for picking up heat by transport over said trip strips and a second branch which flows beneath said trip strips for accelerating a local flow of cooling fluid and transporting heat.

26. The turbine engine component according to claim 16, further comprising a second cooling microcircuit embedded within a suction side wall.

27. The turbine engine component according to claim 26, wherein said second cooling microcircuit has a U-shaped portion and said first cooling microcircuit has an outlet nozzle positioned within a space defined by said U-shaped portion.

* * * * *